United States Patent [19]

Young et al.

[11] Patent Number: 4,870,824

[45] Date of Patent: Oct. 3, 1989

[54] PASSIVELY COOLED CATALYTIC COMBUSTOR FOR A STATIONARY COMBUSTION TURBINE

[75] Inventors: William E. Young, Churchill Borough, Pa.; Dan E. Carl, Orchard Park, N.Y.

[73] Assignee: Westinghouse Electric Corp., Pittsburgh, Pa.

[21] Appl. No.: 92,848

[22] Filed: Aug. 24, 1987

[51] Int. Cl.[4] ..... F02C 1/00

[52] U.S. Cl. ..... 60/723; 60/732; 431/328

[58] Field of Search ..... 60/723, 722, 732, 749, 60/299; 431/7, 170, 328

[56] References Cited

U.S. PATENT DOCUMENTS

| | | | |
|---|---|---|---|
| 2,964,907 | 12/1960 | Toone | 60/723 |
| 4,008,570 | 2/1977 | Harada | 60/299 |
| 4,081,958 | 8/1978 | Schelp . | |
| 4,101,287 | 8/1978 | Sweed et al. . | |
| 4,202,168 | 5/1980 | Acheson et al. | 60/723 |
| 4,202,169 | 5/1980 | Acheson et al. | 60/723 |
| 4,285,193 | 8/1981 | Shaw et al. | 60/39.06 |
| 4,413,470 | 11/1983 | Schelhing et al. | 60/39.32 |
| 4,459,126 | 7/1984 | Krill et al. | 431/7 |
| 4,603,547 | 8/1986 | Pfefferle et al. | 60/723 |
| 4,673,349 | 6/1987 | Abe et al. | 431/7 |

FOREIGN PATENT DOCUMENTS

| | | |
|---|---|---|
| 0144094 | 5/1985 | European Pat. Off. . |
| 60-64131 | 4/1985 | Japan . |
| 2092291 | 6/1982 | United Kingdom . |

OTHER PUBLICATIONS

Roessler, W. U. et al., "Investigation of Surface Combustion Concepts for $NO_x$ Control in Utility Boilers and Stationary Gas Turbines", NTIS, Aug. 1973, pp. 6-1 to 6-26.

Progressin Engergy and Combustion Science, vol. 12, No. 1, Dec. 1986, pp. 25-41, Pergamon.

Journals Ltd., Oxford GB; W. C. Pfefferle et al, "Catalytically Stabilized Combustion", May 1986, whole article.

*Primary Examiner*—Louis J. Casaregola
*Assistant Examiner*—Timothy S. Thorpe
*Attorney, Agent, or Firm*—R. A. Stoltz

[57] ABSTRACT

A catalytic combustor unit for a stationary combustion turbine includes a substrate composed of a plurality of intersecting walls defining a series of generally parallel passages aligned in rows and columns, open at their opposite ends and exposed to a heated flow of fuel and air mixture therethrough. The walls have sections which border and define the respective passages. Each wall section is in common with two adjacent passages and has a pair of oppositely-facing surface regions, one of which is exposed to one of the two adjacent passages and the other exposed to the other of the two adjacent passages. A catalyst coating is applied on selected ones of the wall surface regions exposed to certain ones of the passages, whereas selected others of the wall surfaces exposed to certain others of the passages are free of the catalyst coating. The substrate is thus provided with an arrangement of catalyzed passages in which the mixture is catalytically reacted and non-catalyzed passages in which the mixture is substantially not reacted but instead provides passive cooling of the substrate.

7 Claims, 3 Drawing Sheets

PASSIVELY COOLED CATALYTIC COMBUSTOR FOR A STATIONARY COMBUSTION TURBINE

CROSS REFERENCE TO RELATED APPLICATIONS

Reference is hereby made to the following copending application dealing with related subject matter and assigned to the assignee of the present invention: "Method of Reducing $NO_X$ Emissions from a Stationary Combustion Turbine" by Paul W. Pillsbury, assigned U.S. Ser. No. 030,002, filed Mar. 23, 1987. now U.S. Pat. No. 4,726,181.

BACKGROUND OF THE INVENTION

1. Field of the Invention

The present invention relates generally to stationary combustion turbines and, more particularly, is concerned with a catalytic combustor employing an arrangement of catalyzed and non-catalyzed substrate passages for providing passive cooling of the catalytic combustor.

2. Description of the Prior Art

In the operation of a conventional combustion turbine, intake air from the atmosphere is compressed and heated by rotary action of a multi-vaned compressor component and caused to flow to a plurality of combustor components where fuel is mixed with the compressed air and the mixture ignited and burned. The heat energy thus released then flows in the combustion gases to the turbine component where it is converted into rotary energy for driving equipment, such as for generating electrical power or for running industrial processes. The combustion gases are finally exhaused from the turbine component back to the atmosphere.

Various schemes have been explored to adapt combustion turbines for the aforementioned uses without exceeding $NO_X$ emission limits. The use of catalytic combustion is a promising approach because it can occur at about 2300 to 2500 degrees F to produce a high turbine inlet temperature for turbine operating efficiency without any significant side effect $NO_X$ generation from reactions between nitrogen and oxygen which occurs at temperatures over 3000 degrees F. In contrast, conventional flame combustion at about 4500 degrees F results in $NO_X$ generation which typically exceeds the limits set in more restrictive areas such as California.

Representative of prior art catalytic combustor arrangements for use with a combustion turbine are those disclosed in U.S. Pat. Nos. to Pfefferle (3,846,979 and 3,928,961), DeCorso et al (3,938,326 and 3,943,705), Mosier et al (4,040,252), Sanday (4,072,007), Pillsbury et al (4,112,675), Shaw et al (4,285,192), and Scheihing et al (4,413,470); and Canadian Patent Nos. 1,070,127, 1,169,257 and 1,179,157.

In a typical catalytic combustor, such as disclosed in U.S. Pat. No. 4,413,470 and Canadian Patent No. 1,169,257, active catalysts being supported (i.e. coated) on various substrates (e.g. ceramic honeycomb structures) provide an effective means of initiating and stabilizing the combustion process when they are used with suitable mixtures of fuel and air. These combustion catalysts have several desirable characteristics: they are capable of minimizing $NO_X$ emission and improving the pattern factor. However, one of their limitations is that their maximum operating temperature tends to be only marginally acceptable as an turbine inlet temperature.

This limitation is inherent in the way the typical catalytic combustor operates. Catalysts initiate the combustion reaction at their surfaces and at temperatures lower than normal ignition temperature. However, once the reaction is initiated, it continues in the gas stream and persists beyond the catalyst in the form of afterburning. Simultaneously, the catalyst substrate temperature increases, resulting in an accelerated reaction which moves the reaction zone further upstream in the catalyst. The result may be damage of the catalyst and/or catalyst substrate if the fuel/air ratio is such as to give an excessive catalyst outlet temperature. Presently available catalysts have the capability of extended operation at about 2289 degrees F (1527 degrees K). However, a turbine inlet temperature of around 2500 degrees F is desired. Thus, given the aforementioned current catalyst temperature limits, the catalyst is clearly incapable of providing such turbine inlet temperature.

Consequently, a need exists for a technique to achieve a higher catalyst operating temperature requirements without damaging the catalyst.

SUMMARY OF THE INVENTION

The present invention provides a catalystic combustor designed to satisfy the aforementioned needs. The catalystic combustor of the present invention employs an arrangement of catalyzed and non-catalyzed substrate passages for providing passive cooling of the catalytic combustor. Such cooling permits the catalyst to function with higher reaction temperatures than otherwise possible and thereby application of the catalytic combustor in higher firing rate combustion turbines. By applying a catalytic coating to a fraction of the walls of the parallel passages of a combustion catalyst substrate, the uncoated passages act to cool the common walls exposed to the reacting flow in the coated passages. Additional applications of the invention include tailoring catalyst reactivity to fuel preparation zone characteristics and/or to turbine inlet pattern factor requirements.

Accordingly, the present invention is directed to a catalytic combustor unit for a stationary combustion turbine, which comprises the combination of: (a) a substrate composed of a plurality of generally parallel passages open at their opposite ends and exposed to a heated flow of fuel and air mixture therethrough; and (b) selected ones of the passages being coated with a catalyst and others of the passages being free of the catalyst so as to provide the substrate with an arrangement of catalyzed passages in which the mixture is catalytically reacted and non-catalyzed passages in which the mixture is substantially not reacted but instead provides passive cooling of the substrate.

More particularly, the substrate is composed of a plurality of intersecting walls defining the generally parallel passages being aligned in rows and columns. The walls have sections which border and define the respective passages. Each wall section is in common with two adjacent passages and has a pair of oppositely-facing surface regions, one of which is exposed to one of the two adjacent passages and the other exposed to the other of the two adjacent passages.

Furthermore, the catalyst coating is applied on selected ones of the wall surface regions exposed to certain ones of the passages, whereas selected others of the wall surfaces exposed to certain others of the passages are free of the catalyst coating. In such manner, the substrate is provided with the arrangement of catalyzed passages in which the mixture is catalytically reacted and non-catalyzed passages in which the mixture is substantially not reacted but instead provides passive cooling of the substrate. Also, the selected ones of the surface regions have catalyst coating thereon and the selected others of the surface regions being free of catalyst coating are on common wall sections such that a catalytic reaction can occur in those passages bordered by the catalyzed surface regions concurrently as cooling occurs in those passages being adjacent thereto and bordered by the non-catalyzed surface regions.

Any arrangement of catalyzed and non-catalyzed passages is possible. In one arrangement, the catalyzed to non-catalyzed passages are in a ratio of one-to-one. In another arrangement, they are in a ratio of three-to-one.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
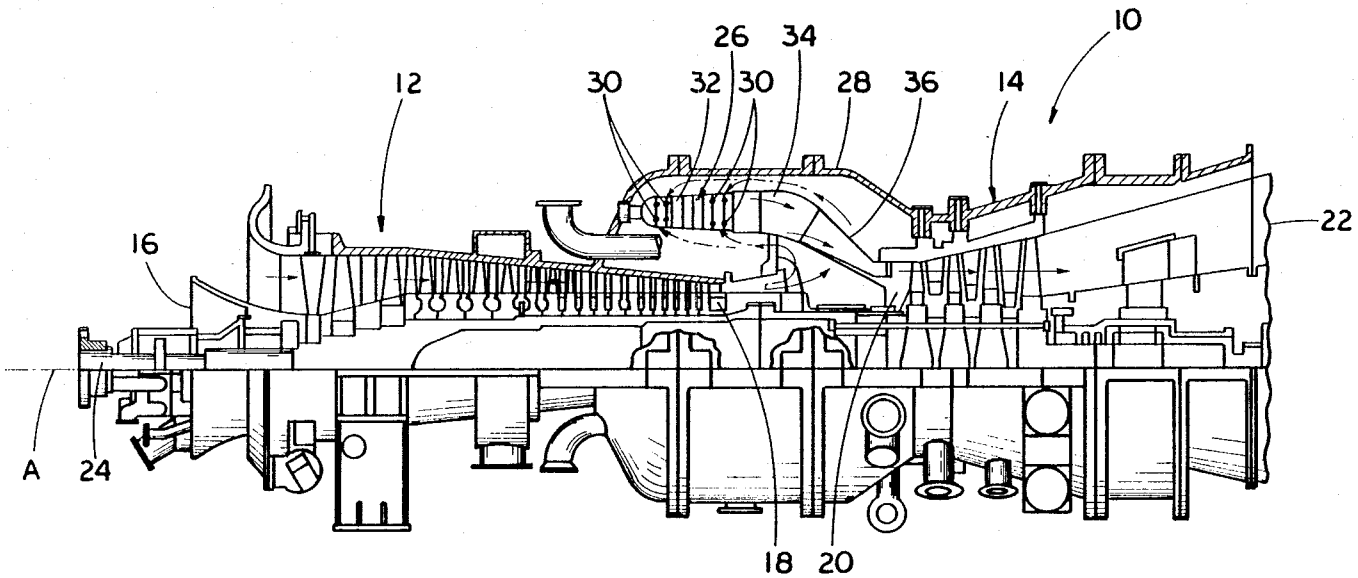
FIG. 1 is a cutaway side elevational detailed view of a conventional stationary combustion turbine.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is illustrated in detail a conventional combustion turbine 10 of the type used for driving equipment (not shown) for generating electrical power or for running industrial processes. The particular turbine of the illustrated embodiment is Westinghouse model W501D, a 92 megawatt combustion turbine. The combustion turbine 10 basically includes a multi-vaned compressor component 12 and a multi-vaned turbine component 14. The compressor and turbine components 12,14 both have opposite inlet and outlet ends 16,18 and 20,22 and are mounted on a common rotatably shaft 24 which defines a longitudinal rotational axis A of the turbine 10.

Also, the turbine 10 includes a plurality of hollow elongated combustor components 26, for instance sixteen in number, being spaced circumferentially from one another about the outlet end 18 of the compressor component 12 and radially from the longitudinal axis A of the turbine. The combustor components 25 are housed in a large cylindrical casing 28 which surrounds the compressor component outlet end 18. The casing 28 provides flow communication between the compressor component outlet end 18 and inlet holes 30 in the upstream end portions 32 of the combustor components 26. Each of the downstream ends 34 of the respective combustor components 26 are connected by a hollow transition duct 36 in flow communication with the turbine inlet end 20.

Figure 2:
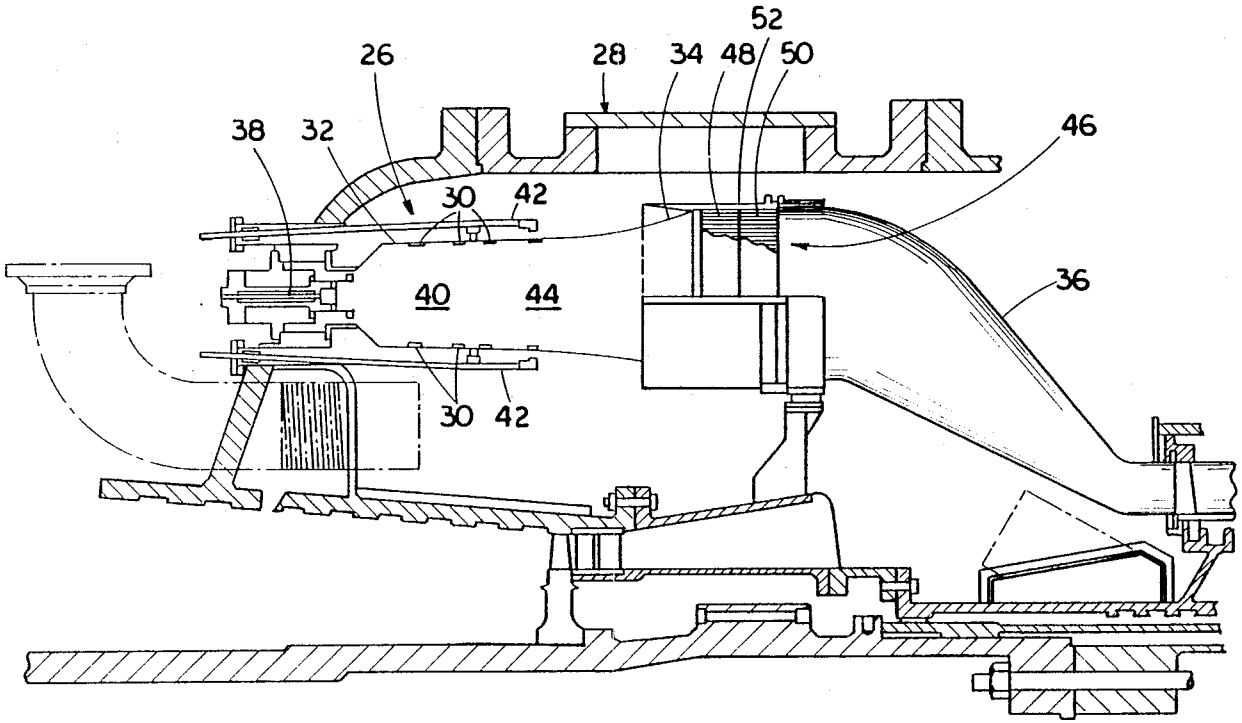
FIG. 2 is an enlarged view, partly in section, of one of the combustors of the turbine of FIG. 1 modified to incorporate a catalytic combustor constructed in accordance with the principles of the present invention.

Referring also to FIG. 2, a primary fuel nozzle 38 and an igniter (not shown), which generates a small conventional flame (not shown), are provided in communication with a primary combustion zone 40 defined in the interior of the upstream end portion 32 of each combustor component 26. Forwardmost ones of the inlet holes 30 of the respective combustor components 26 provide flow communication between the interior of the casing 28 and the primary combustion zone 40. In addition, a plurality of secondary fuel nozzles 42 are provided along each of the combustor components 26 and align with rearwardmost ones of the inlet holes 30 and a fuel preparation zone 44 located downstream of the primary combustion zone 40. Between the fuel preparation zone 44 and the transition duct 36 is located a catalytic combustor unit 46 composed of a pair of tandemly-arranged catalytic elements 48,50.

In the conventional operation of the turbine 10, intake air from the atmosphere is drawn into the compressor component 12 through its inlet end 16, and then compressed and heated therein, by rotational movement of its vanes with the common shaft 24 about the axis A. The compressed and heated air is caused to flow in the direction of the arrows in FIG. 1 through the compressor component 12 and the casing 28 and into the plurality of combustor components 26 through their inlet holes 30 in the upstream end portions 32 thereof.

Carbon fuel from the primary fuel nozzle 38 flows into the primary combustion zone 40 where it is mixed with the heated and compressed air and the mixture ignited and burned, producing a flow of hot combustion gas. At the fuel preparation zone 44, more carbon fuel from the secondary fuel nozzles 42 is entrained and burned in hot gas flow. The hot gas flow then enters the catalytic combustor unit 46 where catalytic combustion occurs. The heat energy thus released is carried in the combustion gas flow through the inlet end 20 of the turbine component 14 wherein it is converted into rotary energy for driving other equipment, such as for generating electrical power, as well as rotating the compressor component 12 of the turbine 10. The combustion gas is finally exhausted from the outlet end 22 of the turbine component 14 back to the atmosphere.

Figure 3:
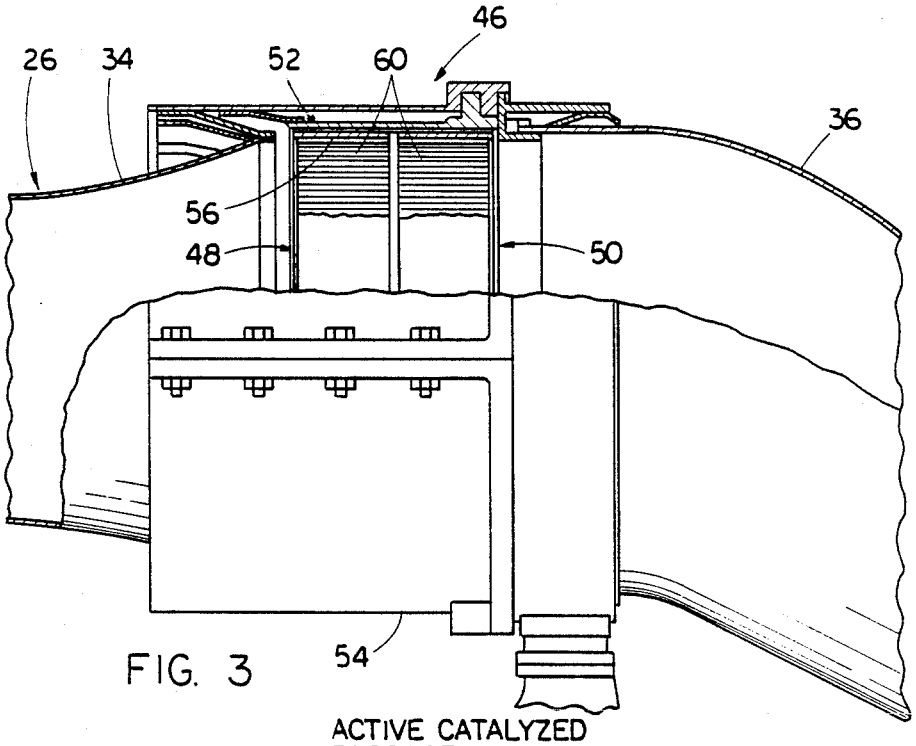
FIG. 3 is an enlarged view, partly in section, of the catalytic combustor of FIG. 2, also illustrating the downstream end of a combustor and upstream end of a transition duct which both are positioned in flow communication with the catalytic combustor.

As shown in FIG. 3, the catalytic combustor unit 46 includes a can 52 within which a catalytic monolithic honeycomb structure is supported in the form of elements 48,50, which are substantially identical to one another. The catalyst characteristics may be as follows:

| DATA FOR DXE-442 CATALYST | |
|---|---|
| 1. Substrate | |
| Size | (2" + 2") long – (¼" gap) between two elements) |
| Material | Zircon Composite |
| Bulk Density | 40–42 lb/ft$^3$ |
| Cell Shape | Corrugated Sinusoid |
| Number | 256 Channels/in$^2$ |
| Hydraulic Diameter | 0.0384" |
| Web Thickness | 10 + 2 mils. |
| Open Area | 65.5% |
| Heat Capacity | 0.17 BTU/lb, degrees F. |
| Thermal Expansion Coefficient | $2.5 \times 10^{-6}$ in/in, degrees F. |
| Thermal Conductivity | 10 BTU, in/hr, ft$^2$, degrees F. |
| Melting Temperature | 3050 degrees F. |
| Crush Strength | |
| Axial | 800 PSI |
| 90 | 25 PSI |
| II. Catalyst | |
| Active Component | Palladium |
| Washcoat | Stabilized Alumina |

As conventionally known, the catalytic can 52 is mounted in a clam shell housing 54. Within the can 52, a compliant layer 56 surrounds the monolithic catalytic elements 48,50 to absorb vibrations imposed from external sources. The transition duct 36 and the combustor component 26 are connected through the shell housing 54 of the catalytic unit 46. As a result, hot gas flows along a generally sealed path from the fuel preparation zone 44, through the catalytic elements 48,50 where catalytic combustion occurs when the hot gas contains a fuel-air mixture, and finally through the transition duct 36 to the turnbine component 14 inlet end. The mounting of the catalytic unit 46 to the combustor component 26 and transition duct 36 and of the catalytic elements 48,50 in the can 52 are described in detail in aforecited U.S. Pat. No. 4,413,470. Since such mounting arrangements form no part of the present invention, they will not be repeated herein.

Figure 4:
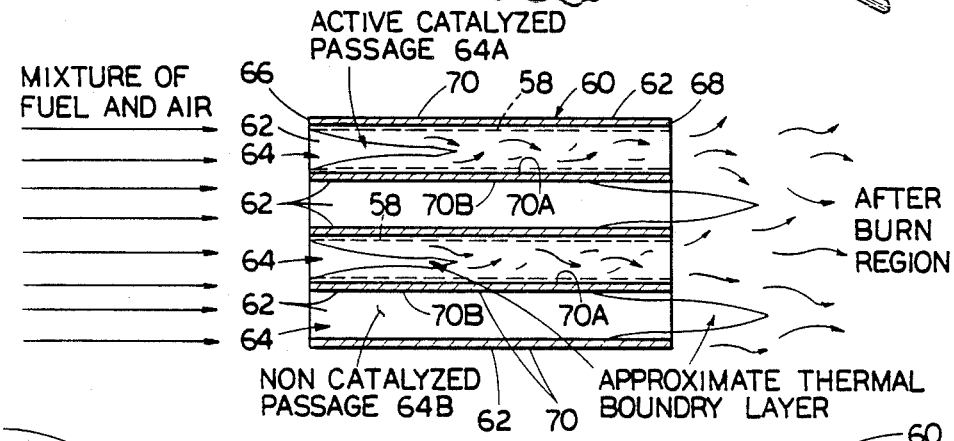
FIG. 4 is a schematic longitudinal sectional view of a portion of the substrate of the catalytic combustor, illustrating catalyzed and non-catalyzed passages therein.
Figure 5:
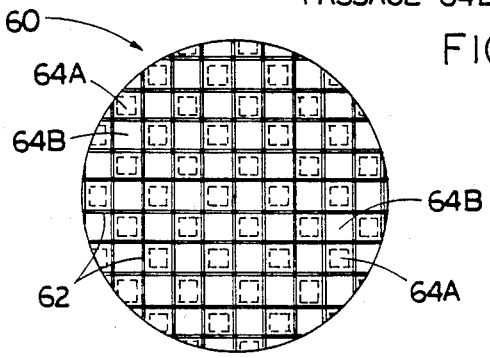
FIG. 5 is a schematic end view of the catalytic combustor substrate, illustrating one arrangement of the catalyzed and non-catalyzed passages in a one-to-one ratio therein.
Figure 6:
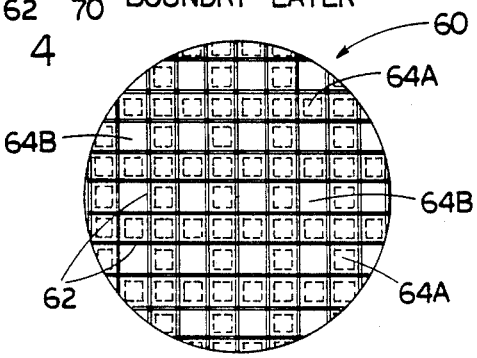
FIG. 6 is also a schematic end view of the catalytic combustor substrate, illustrating another arrangement of the catalyzed and non-catalyzed passages in a three-to-one ratio therein.

Turning to FIGS. 4–6, the present invention relates to the configuration of the catalyst coating 58 applied in the honeycomb structure of the catalytic elements 48,50. In the preferred embodiment, the honeycomb structure of each element 48,50 is per se a conventional cylindrical monolithic substrate 60 composed of a plurality of criss-cross intersecting walls 62 defining a series of generally parallel passages 64, being generally rectangular in cross-section, aligned in rows and columns and extending between and open at upstream and downstream ends 66,68 thereof.

As is readily apparent in FIGS. 4–6, successively-located sections 70 of the walls 62 border and define the respective passages 64. Each wall section 70 is common to two adjacent passages 64 and has a pair of oppositely-facing surfaces 70A,70B, one exposed to one of the two adjacent passages 64 and the other exposed to the other of the two adjacent passages.

The catalyst coating 58 is applied on selected ones of the wall surfaces 70A,70B exposed to certain ones of the passages 64A, whereas selected others of the wall surfaces 70A,70B exposed to certain others of the passages 64B are free of the catalyst coating. In such manner, the substrate 60 is provided with the desired arrangement of catalyzed passages 64A in which the mixture is catalytically reacted and non-catalyzed passages 64B in which the mixture is substantially not reacted but instead provides passive cooling of the substrate 60.

It will also be observed that the selected ones of the wall surfaces 70A,70B having the catalyst coating 58 thereon and the selected others of the wall surfaces 70A,70B being free of catalyst coating can be on common wall sections such that a catalytic reaction can occur in those passages 64A bordered by the catalyzed surfaces concurrently as cooling occurs in those passages 64B being adjacent thereto and bordered by the non-catalyzed surfaces. Any arrangement of catalyzed and non-catalyzed passages is possible. In one arrangement shown in FIG. 5, the catalyzed passages 64A to non-catalyzed passages 64B are in a ratio of one-to-one. In another arrangement shown in FIG. 6, the catalyzed passages 64A to non-catalyzed passages 64B are in a ratio of three-to-one.

A catalytic combustor unit 46 thus provided with such passive substrate cooling will be able to operate with a richer mixture of fuel and air (i.e., higher firing rates) and at lower velocities without overheating and damaging the catalyst or catalyst substrate. This, in effect, serves to raise the maximum temperature of the catalyst. Another advantage of the arrangement of the present invention is that the reacting passages provide stable, high temperature, continuous, and uniform ignition sources for the balance of the unreacted mixture which then burns at the desired high temperature just downstream of the catalytic combustor unit. In effect, the unit is a hybrid of a catalytic combustor and a flameholder.

It is recognized that any hot surface acts as a catalyst to some degree, hence even the non-catalyzed passages 64B may tend to provide some surface combustion. This effect will be minimized by selecting a ceramic base material with minimal catalytic properties. It may also be possible to control the boundary layer, decrease the surface area, decrease the residence time, and perhaps even provide a chain breaking or ignition delaying surface, such as $P_2O_5$.

By means of the present invention, the catalytic elements can be engineered to provide the reactivity across the unit best tailored to the fuel preparation zone characteristics, or to the requirements of the turbine inlet pattern factor.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. In a catalytic combustor unit for a stationary combustion turbine, the combination comprising:

(a) a substrate composed of a plurality of intersecting walls having surface regions and defining a plurality of generally parallel passages open at their opposite ends and exposed to a heated flow of fuel and air mixture therethrough; and (b) a catalyst applied on selected ones of said wall surface regions exposed to certain ones of said passages, selected others of said wall surface regions exposed to certain others of said passages being free of said catalyst so as to provide said substrate with an arrangement of catalyzed passages in which said mixture is catalytically reacted and non-catalyzed passages in which said mixture is substantially not reacted but instead provides passive cooling of said substrate;

(c) each of said selected wall surface regions which are free of said catalyst being on a common wall section with one of said selected wall surface regions having catalyst coating thereon such that non-reactive cooling occurs in passages bordered by said non-catalyzed wall surface regions of said common wall sections concurrently as catalytic reactions occur in passages bordered by said catalyzed wall surface regions of said common wall sections.

2. The unit as recited in claim 1, wherein said catalyzed to non-catalyzed passages are in a ratio of one-to-one.

3. The unit as recited in claim 1, wherein said catalyzed to non-catalyzed passages are in a ratio of three-to-one.

4. In a catalytic combustor unit for a stationary combustion turbine, the combination comprising:

(a) a substrate composed of a plurality of walls defining a plurality of passages open at their opposite ends and exposed to a heated flow of fuel and air mixture therethrough, each of said walls having sections which border and define said respective passages, each wall section being in common with two adjacent passages and having a pair of oppositely-facing surface regions, one of which being exposed to one of said two adjacent passages and the other being exposed to the other of said two adjacent passages; and (b) a catalyst applied on selected ones of said wall surface regions exposed to certain ones of said passages, selected others of said wall surface regions exposed to certain others of said passages being free of said catalyst so as to provide said substrate with an arrangement of catalyzed passages in which said mixture is catalytically reacted and non-catalyzed passages in which said mixture is substantially non reacted but instead provides passive cooling of said substrate;

(c) each of said selected wall surface regions which are free of said catalyst being on a common wall section with one of said selected wall surface regions having catalyst coating thereon such that non-reactive cooling occurs in passages bordered by said non-catalyzed wall surface regions of said common wall sections concurrently as catalytic reactions occur in passages bordered by said catalyzed wall surface regions of said common wall sections.

5. In a catalytic combustor unit for a stationary combustion turbine, the combination comprising:

(a) a substrate composed of a plurality of criss-cross intersecting walls defining a series of generally parallel passages aligned in rows and columns, open at their opposite ends and exposed to a heated flow of fuel and air mixture therethrough, said walls having sections which border and define the respective passages, each wall section being in common with two adjacent passages and having a pair of oppositely-facing surface regions, one of which is exposed to one of said two adjacent passages and the other exposed to the other of said two adjacent passages; and (b) a catalyst coating on selected ones of said wall surface regions exposed to certain ones of said passages, selected others of said wall surface regions exposed to certain others of said passages being free of said catalyst coating so as to provide said substrate with an arrangement of catalyzed passages in which said mixture is catalytically reacted and non-catalyzed passages in which said mixture is substantially not reacted but instead provide passive cooling of said substrate;

(c) each of said selected wall surface regions which are free of said catalyst being on a common wall section with one of said selected wall surface regions having catalyst coating thereon such that non-reactive cooling occurs in passages bordered by said non-catalyzed wall surface regions of said common wall sections concurrently as catalytic reactions occur in passages bordered by said catalyzed wall surface regions of said common wall sections.

6. The unit as recited in claim 5, wherein said catalyzed to non-catalyzed passages are in a ratio of one-to-one.

7. The unit as recited in claim 5, wherein said catalyzed to non-ctaalyzed passages are in a ratio of three-to-one.

* * * * *